United States Patent [19]

Watson

[11] Patent Number: 4,648,217

[45] Date of Patent: Mar. 10, 1987

[54] EXPANSION ROOF

[76] Inventor: Vincent O. Watson, 705 Washington St., Dedham, Mass. 02026

[21] Appl. No.: 771,189

[22] Filed: Sep. 3, 1985

Related U.S. Application Data

[63] Continuation of Ser. No. 471,642, Mar. 3, 1983, abandoned.

[51] Int. Cl.[4] ..... E04B 7/02

[52] U.S. Cl. ..... 52/90; 52/92; D25/17; D25/22

[58] Field of Search ..... 52/90, 92, 82, 13, 720, 52/730; D25/17, 22

[56] References Cited

U.S. PATENT DOCUMENTS

| | | | |
|---|---|---|---|
| D. 191,438 | 10/1961 | Paulson | D25/22 |
| D. 227,456 | 6/1973 | Fulmer | D25/22 |
| 595,010 | 12/1897 | Woods | 52/90 |
| 672,646 | 4/1901 | Merenese, Jr. | 52/730 |
| 788,024 | 4/1905 | Covey | 52/720 |
| 3,090,162 | 5/1963 | Baroni | 52/13 |
| 3,177,618 | 4/1965 | Jacob | 52/90 |
| 3,263,302 | 8/1966 | Handley | 52/720 |
| 3,283,693 | 11/1966 | Howell | 52/90 |
| 3,530,621 | 9/1970 | Rutzebeck | 52/81 |
| 3,534,515 | 10/1970 | Beed | 52/92 |
| 3,562,974 | 2/1971 | Niemeyer | 52/82 |
| 3,654,741 | 4/1972 | MacDonell | 52/720 |
| 3,760,856 | 9/1973 | Kough et al. | 52/13 |
| 3,908,322 | 9/1975 | Shoaf | 52/90 |
| 4,275,534 | 6/1981 | Porter | 52/82 |
| 4,335,558 | 6/1982 | Caldwell et al. | 52/13 |
| 4,476,663 | 10/1984 | Bikales | 52/730 |

*Primary Examiner*—Carl D. Friedman
*Assistant Examiner*—Michael Safavi
*Attorney, Agent, or Firm*—Denis G. Maloney

[57] ABSTRACT

An expansion roof for connecting two roofs adjacent thereto, includes a first pair of hip rafters associated with a first one of said adjacent roofs and a second pair of hip rafters associated with a second one of said adjacent roofs. Each pair of hip rafters is connected at a corresponding one of a pair of common points, and each hip rafter of the first pair of hip rafters has an end portion colinearly aligned with an end portion of a corresponding hip rafter of the second pair. Horizontal or expansion rafters are disposed between such corresponding hip rafters, and a center ridge board member is connected between the pair of common points.

With such an arrangement, interior load carrying support structures generally used when connecting different roofs together are eliminated.

In one embodiment, a tapered, beveled surface is provided to each of such expansion rafters where adjacent roofs are at different elevations and pitches, so that sheathing disposed across said expansion rafters will follow a pitch of the expansion rafter, and provide a close fit of the sheathing to the expansion rafters.

16 Claims, 13 Drawing Figures

32
132
24a
23b
26a
126a
14c
14c'
14c''
14c'''
23a
124a
114c
17a
34a
36a
43a
44a
14b
14b'
14b''
14b'''
43b
48a
14e
14d
14f
14g
14a
27f
27e
27d
27c
27b
27a
25b
25a
22
26f
26e
26d
26c
26b
26a
24b
24a
23b
23a
34b
36b
36a
34a
39
43a
44b
44a
43b
48a
49b
49a
42
47f
47e
47d
43m
43l
43n
43k
48b
44c
43j
44d
43i
43h
43g
46f
46e
46d
46c
46b
46a
44e
43c
43d
43f
43e
A
B
C

EXPANSION ROOF

This application is a continuation of application Ser. No. 471,642 filed Mar. 3, 1983, now abandoned.

BACKGROUND OF THE INVENTION

This invention relates generally to building structures, and more particularly to building structures having rafter framed roofs.

As is known in the art, building structures are often provided with multiple roof structures, having roofs of different elevations and pitches. Generally, in order to provide a roof structure for such a building, it is required to provide interior carrying beams and support columns for each one of such roofs at each one of such levels. While this solution is an adequate solution for many applications, it does unnecessarily increase the cost of the building by requiring the use of expensive support columns and load carrying beams to support each one of such roofs at each elevation level. Further, the use of support and carrying beams in such a structure present interior obstructions which restrict the size and layout of rooms. Further still, the amount of open space between the floor and the ceiling is likewise restricted by the use of interior support columns and load carrying beams restricting location of stairways and head room in stairways. Further still, in some buildings it is often desired to provide an atrium. An atrium is generally considered to be an aesthetically desirable feature in certain buildings such as large houses. However, with interior support columns and load carrying beams required to join roofs of different elevation and pitch, for example, construction of an atrium where the two roofs join is difficult.

SUMMARY OF THE INVENTION

In accordance with the present invention, framing for a roof includes a first pair of divergently spaced members, each one of such members having a first end portion connected at a first common point, and a second pair of divergently spaced members, each one having a first end portion connected at a second common point. A second end portion of each one of such members of the first pair is colinearly aligned with a second end portion of a corresponding one of the second pair. A longitudinal member is connected between the common points of each of the connected pairs of members and a plurality of spaced rafter members is connected between corresponding ones of each of the pair of divergently spaced members. With such an arrangement, the framing for a roof is provided which eliminates the necessity for carrying beams and interior support columns providing an area of open living space adaptable to a wide range of room layouts.

In accordance with an additional aspect of the present invention, a roof structure for a building includes a first pair of hip rafters associated with a first roof, each hip rafter having a first end connected at a first common point, and having second end portions connected at first points with exterior walls of the building, and a second pair of hip rafters associated with a second roof, each hip rafter having a first end connected at a second common point, and each having a second end portion colinearly aligned with the second end portion of such first pair of hip rafters and connected at second points of the exterior walls of the building. A horizontal member is connected between the common points of each of said pair of hip rafters. A plurality of expansion rafters having selective compound angle cuts at ends thereof are then connected at spaced intervals between a corresponding one of pair of hip rafters. With this arrangement, an expansion roof structure is provided which eliminates the necessity for carrying beams and interior support columns thereby providing an area of living space adaptable to a wide range of room layouts. Further, since the carrying beams and support structures generally associated with prior roofing structures are eliminated, an atrium entrance way effect is provided resulting in an unobstructed view of the entire interior area.

In an alternate embodiment of the present invention, each one of pairs of expansion roof rafters include selectively tapered longitudinally beveled surface portions which provide a curved centerline. The tapered, beveled surface and hence the curved centerline are determined by the pitch of each one of the expansion rafters. A plurality of selectively tapered sheathing is fastened across the tapered, beveled surface of each one of the rafters. With this arrangement, a roof structure is provided with the sheathing being gradually elevated and pitched from a lower portion to an upper portion following the individual pitches of each one of the expansion rafters, and thus permitting roofs of unequal elevation and pitch to be joined without the necessity of support columns and carrying beams. Further, a fan-like roof covering is provided by the gradually elevated tapered sheathing, resulting in an aesthetically appealing and structurally sound roof.

In accordance with an additional aspect of the present invention, an expansion roof includes a plurality of horizontally disposed rafter members disposed between end portions of a pair of roofs with tongue and groove sheathing members disposed across such rafter members. With such an arrangement, an aesthetically pleasing interior ceiling associated with the roof is provided which eliminates interior finishing materials, such as plaster or dry wall for the ceiling thereby further reducing the cost of building and also eliminates costly interior support structures.

BRIEF DESCRIPTION OF THE DRAWINGS

For a more complete understanding of the concepts of this invention, reference is now made to the following description taken together in conjunction with the accompanying drawings, in which.

DESCRIPTION OF THE PREFERRED EMBODIMENTS

Figure 1:
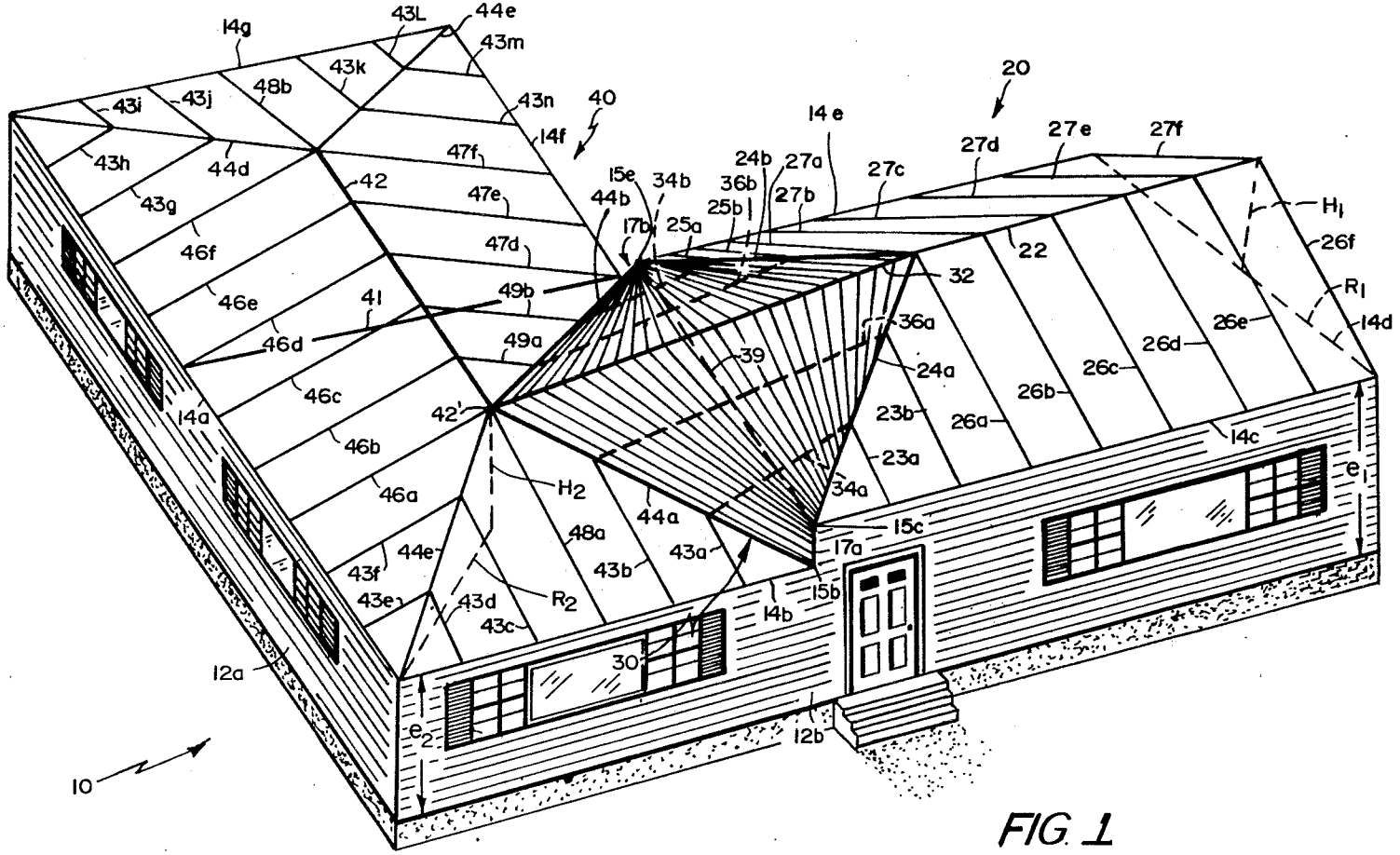
FIG. 1 is an isometric view of a building having a plurality of roofs including a roof constructed in accordance with the present invention.
Figures 1A, 3:
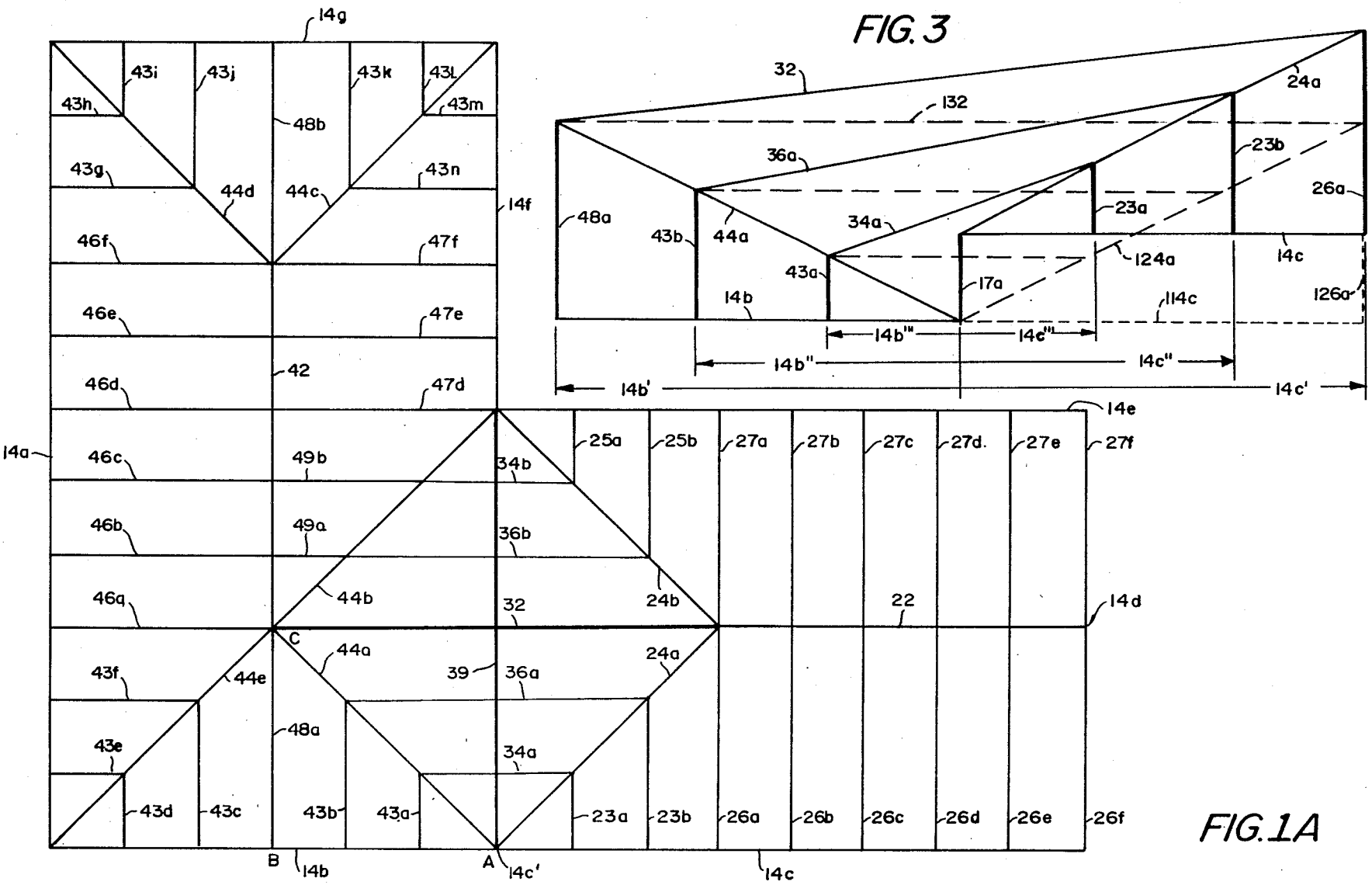
FIG. 1A is a diagrammatical plan view of the plurality of roofs shown in FIG. 1.
FIG. 3 is an elevational view of the framing of the roof structure useful for determining the length of framing members of the roof.

Referring now to FIGS. 1 and 1A, a building 10 is shown to include a framing for a modified gable roof 20 and a hip roof 40 here joined together by framing for an expansion roof 30 disposed between said gable roof 20 and hip roof 40, as shown. The building further includes conventionally framed exterior walls 12*a*, 12*b*, as shown. Disposed and fastened to upper edge surfaces of such exterior walls are horizontally disposed flat members 14*a*–14*h* commonly referred to as top plates.

Modified gable roof (gable roof) 20 here includes a center horizontally disposed member 22, generally referred to as a ridge board, supported on opposing facial surfaces thereof, by a plurality of spaced members 26*a*–26*f* and 27*a*–27*f* extending between the ridge board 22 and plates 14*c*, 14*e*, as shown. The plurality of spaced members or, as generally referred to as common rafters 26*a*–26*f*, 27*a*–27*f*, are thus extended from the ridge board 22 to the plates 14*c*, 14*d*, respectively, at a 90° angle with respect to the ridge board 22 and respective ones of such plates 14*c*, 14*e*. Modified gable roof 20 here includes a pair of divergently spaced members 24*a*, 24*b* commonly referred to as hip rafters. Hip rafters 24*a*, 24*b* here are connected together in a conventional manner at an end portion 22' of ridge board 22 and extend divergently outward to end portions 14*c'*, 14*e'* of plates 14*c*, 14*e*, respectively. Hip rafters 24*a*, 24*b* are connected between corner portions 15*c*, 15*e* of plates 14*c*, 14*e* and the ridge board 22 at an angle of 45°, as is known in the art. Modified gable roof 20 further includes hip support members 23*a*, 23*b* and 25*a*, 25*b* commonly referred to as hip jack rafters, here extending between spaced portions along hip rafters 24*a*, 24*b* to spaced portions of plates 14*a*, 14*b*, respectively, as shown.

Hip roof 40 here includes a second central horizontal member or ridge board 42 here supported by a plurality of spaced common rafters 46*a*–46*f*, 47*d*–47*f*, as shown. Common rafters 46*a*–46*f* here extend between ridge board 42 and plate 14*a*, and the common rafters 47*d*–47*f* here extend between ridge board 42 and the plate 14*f*. Hip roof 40 further includes a plurality of divergently spaced members or hip rafters, here 44*a*–44*e*. In particular, hip rafter 44*a* here extends between an end portion 42' of ridge board 42 and an end portion 15*b* of plate 14, and hip rafter 44*b* here extends between an end portion 42' and a first end 15*f* of plate 14*f*. Ridge board 42 is also supported by a pair of common rafters 48*a*, 48*b* disposed between hip rafters 44*e*, 44*a* and 44*d*, 44*c*. Common rafters 48*a*, 48*b* bisect plates 14*b* and 14*g*, respectively. Hip rafters 44*a*–44*e* here are further supported by a plurality of hip jack rafters 43*a*–43*n*. Ridge board 42 is also supported by members 49*a*, 49*b* commonly referred to as valley jack rafters, as shown. A horizontal member 41 commonly referred to as a collar tie is connected between plates 14*a* and 14*f*, as shown.

It is to be noted here that modified gable roof 20 is at a first elevation $e_1$ from the ground and has a predetermined ratio ($H_1/R_1$) of roof run ($R_1$) to roof rise ($H_1$), said ratio or pitch determining the slope of the roof. It is also to be noted that gable roof 20 would also include conventional laid horizontal sheathing (here not shown). The pitch of modified gable roof 20 is here five inches rise per twelve inches run. Similarly, hip roof 40 is at a second, here lower, elevation $e_2$ from the ground and has a predetermined pitch $T_2/h_2$ here of five inches rise per twelve inches run. It is here noted that hip roof 40 would also include conventional laid horizontal sheathing (not shown). The difference in elevation between modified gable roof 20 and hip roof 40 is here 2 feet. Said elevational difference is represented by verticle members 17*a*, 17*b* of the exterior wall 12*b*.

Figures 2, 2A, 4F:
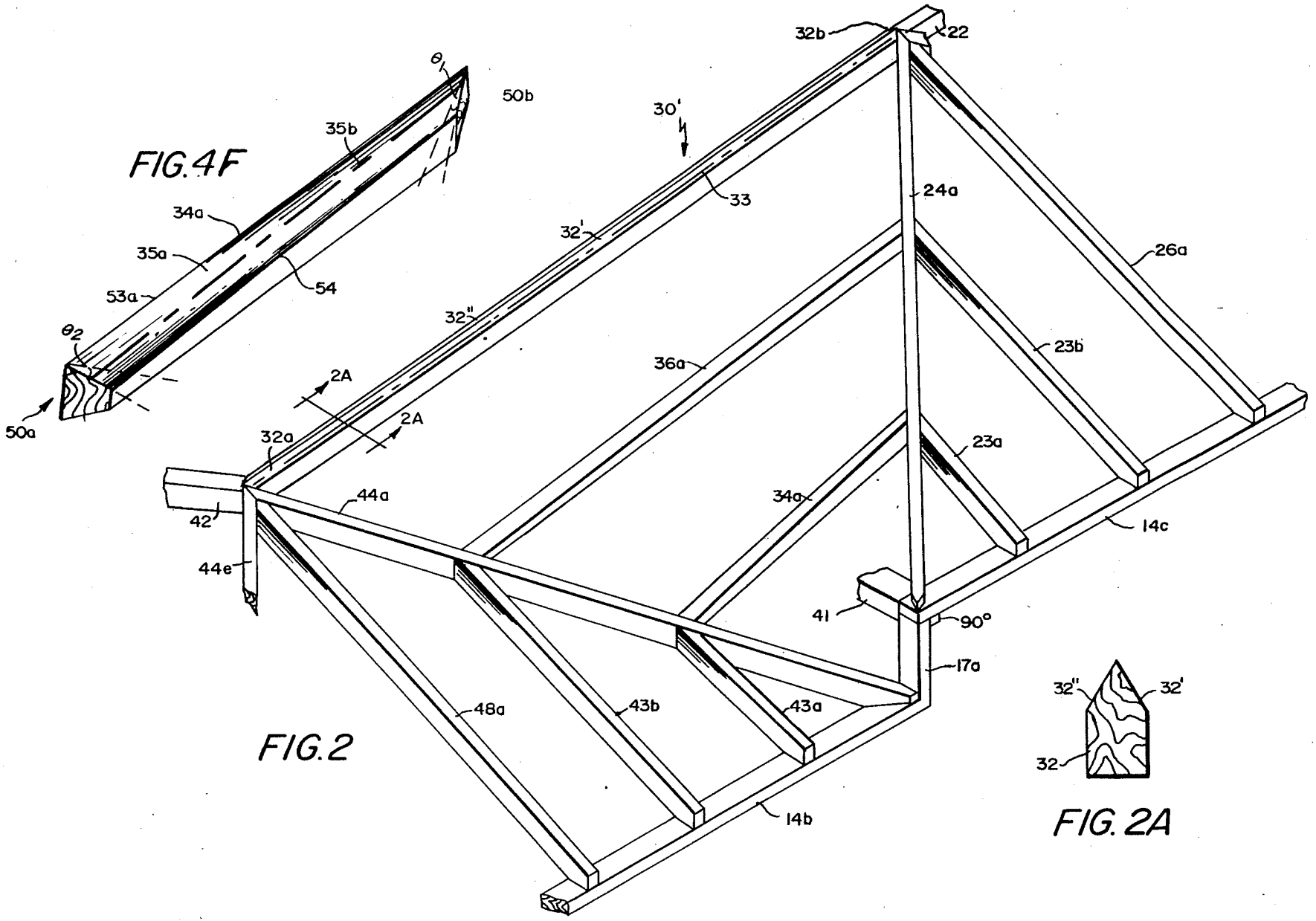
FIG. 2 is an isometric view of a portion of the framing for the roof constructed in accordance with the invention shown in FIGS. 1, 1A.
FIG. 2A is a cross-sectional view of member 32 taken along line 2A—2A of FIG. 2.
FIG. 4F is an isometric view of an expansion rafter 34*a* having a tapered, beveled surface, constructed in accordance with FIGS. 4A–4E.

Referring now also to FIGS. 2 and 2A, a frame for a portion 30' of the expansion roof 30 shown in FIGS. 1 and 1A is shown to include a first horizontal center member 32 fabricated in a manner to be described, joined in a conventional manner at end portions 32*a*, 32*b* thereof to central horizontal members 42 and 22 of roofs 40 and 20, respectively. Horizontal center member here has a pair of longitudinally or bevel surface portions 32',32'' (FIG. 2A) extended from end 32*a* to end 32*b* and fabricated in a manner to be described. End portions 32*a*, 32*b* here have double end cuts at a selected angle or compound angle in accordance with the respective pitch of the center member 32. The ends 32*a*, 32*b* and the pair of tapered, beveled surfaces 32', 32'' are fabricated in a manner to be described in conjunction with FIGS. 4A–4F. The expansion roof 30 is shown to further include a plurality of expansion rafters 34*a*, 34*b* and 36*a*, 36*b*, each having a tapered, beveled surface portion 35*a*, 35*b*, 37*a*, 37*b* providing a curved centerline 35*a*, 35*b*, 37*a*, 37*b* to be described in conjunction with FIGS. 4A–4F. The expansion rafters 34*a*, 36*a* here extend between hip rafter 24*a* and hip rafter 44*a* and said expansion rafters 34*b*, 36*b* here extending between hip rafter 24*b* and hip rafter 44*b*. A horizontal member 39 commonly referred to as a collar tie is here connected between plate 14*c* and plate 14*e*, as shown. The collar tie is here used to aid in support of exterior wall 12*b* and the opposite wall (not numbered) disposed under plate 14*e*. In certain embodiments of the building, the collar tie may be omitted such as when plate 14*c* is not colinear with plate 14*b*, providing a protruding portion (not shown) of exterior wall 12*b*. At this juncture, it should be noted that here with respect to hip roof 40, members 44*b*, 44*c* are hip rafters, whereas with respect to the expansion roof 30, said members 44*b*, 44*c* are valley rafters, that is, said members 44*b*, 44*c* are provided at the intersection of a pair of roofs providing a depressed region or valley at the intersection of such roofs.

Referring again to FIGS. 1 and 1A, a generally known technique for determining a theoretical length $l_t$ of hip rafters 24*a*, 24*b*, 44*a* and 44*b* will be described. The theoretical length $l_t$ of a hip rafter such as hip rafter 44*a*, for example, is determined from the the run and rise of the hip rafter, as is known in the art, where the run is represented as the hypothenuse AC of an isosceles right triangle ABC having a first leg equal to the run of a common rafter 48*a*, and a second leg equal to one half the length of plate 14*b* which is also equal to the run of common rafter 48*a*. Since a unit run ($u_{t48a}$) of common rafter 48*a* is 12", a theoretical unit run $u_{tr44a}$ of the hip rafter 44*a* is given as: $u_{tr44a}=((u_{t48a})^2+(u_{t48a})^2)^{\frac{1}{2}}$ or $u_{tr44a}=(12''^2+12''^2)^{\frac{1}{2}}==(12''^2+12''^2)^{\frac{1}{2}}=17''$. Having determined the unit run of hip rafter 44*a* for example to be 17" per foot run of common rafter, the theoretical length $l_t$ can be determined for any pitch roof by use of a table entitled "length of hip rafter per foot run," generally found on a framing square. The number in such table underneath the pitch of hip rafter 44*a* provides the unit length of hip rafter 44*a* per unit run of common rafter 48*a*. The number is then multiplied by the total theoretical run of the common rafter 48*a* to obtain the theoretical length $l_{t44a}$ of such hip rafter 44*a*.

Having found the theoretical lengths, $l_{t24a}$,$l_{t24b}$,$l_{t44a}$, $l_{t44b}$ of the hip rafters, the actual lengths $l_a$ are determined by subtracting therefrom a length equal to the allowance for the thickness of the ridge pole as is known in the art or as commonly referred to as "the shortening allowance." Thus, for hip rafters disposed against ridge boards 26, 46, the ridge allowance is equal to one-half the 45° thickness of such ridge board 22 or 42 or one half of the length of a line drawn across the edge portion of such ridge board at a 45° angle. Thus, the shortening allowance for the ridge board $l_s$ is used in combination with the theoretical length of the hip rafters to obtain $l_a$ the actual length as: $l_t - l_s = l_a$.

Referring now to FIGS. 3 and 4A–4E, steps in the construction of the expansion rafters 34*a*, 34*b* and 36*a*, 36*b* and central horizontal member 32 having tapered, beveled surfaces will be described.

Referring first to FIG. 3, the determination of actual lengths $l_a$ of ridge board 32 and each one of the expansion rafters (rafter members) 34*a*, 34*b*, 36*a*, 36*b* will be described.

The actual length $l_a$ of rafter members 34*a*, 34*b*, 36*a*, 36*b* and of ridge board 32 is equal to a calculated theoretical length $l_t$ minus a length $l_s$ determined by the angular thickness of the members to which expansion rafters 34*a*, 34*b*, 36*a*, 36*b* are attached, or the shortening allowance, as described above. The theoretical length of such expansion rafters 34*a*, 34*b*, 36*a*, 36*b* and 32 is here determined by the pitch of each one of such members.

The simplest case is where roofs 20' (shown in phantom) and 40 are provided having equal elevations and pitches. In this case, a ridge board 132 (shown in phantom) is at right angles to common rafters 48*a* and 126*a* (shown in phantom) and, thus, the length of such ridge board 132 is equal to the combined length of portions 14*b'* and 114*c'* of plate 14*b* and a plate 114*c* (shown in phantom). It is to be noted that the respective run of common rafters 45*a*, 24*a* equals the respective lengths of portions 14*b'*, 114*c'* of plates 14*b*, 114*c* (shown in phantom), as is known in the art.

For the case where the ridge board 32 is adjoining ridge boards of roofs 20, 40 of equal pitch and different elevation as shown in FIG. 1, FIG. 1A, the length of such ridge board is determined from the difference in elevation and the run of the ridge board 32. As shown in FIG. 3, the theoretical length $l_{t32}$ of such ridge board 32 is represented by the hypothenuse AC of a right triangle ABC, where side BC is representative of the difference in elevation of the roofs 20, 40 here the height of members 17*a*, 17*b* and side AB is the length of the ridge board 132 as previously determined above to be equal to twice the run of one of common rafters 24*a*, 48*a*. Thus, the length of such expansion ridge board 32 is given by:

$$l_{t32} = ((l_{t132})^2 + (h_{17a})^2)^{\frac{1}{2}}$$

using Phythagorean's Theorem.

In a similar manner, by using the runs of jack rafters 23*a*, 23*b*, 25*a*, 25*b* and 43*a*, 43*b*, 45*a*, 45*b*, the respective lengths $l_{34a}$, $l_{34b}$, $l_{36a}$, $l_{36b}$ of expansion rafters 34*a*, 34*b*, 36*a*, 36*b* may be determined from:

$$l_{t34a} = l_{t34b} = ((14b''' + 14c''')^2 + (h_{17a})^2)^{\frac{1}{2}}, \text{ and}$$

$$l_{t36b} = l_{t36b} = ((14b'' + 14c'')^2 + (h_{17a})^2)^{\frac{1}{2}} \text{ as shown in FIG. 3B.}$$

Referring now to FIGS. 4A–4E, fabrication of a selected one of the curvatured, tapered expansion rafters 34*a*, 34*b*, 36*a*, 36*b*, here expansion rafter 34*a* will be described. It is to be noted that expansion rafters 34*a*, 34*b* and 36*a*, 36*b*are fabricated in pairs with one of such rafters 34*a*, 36*a* being the complement of the other remaining one 34*b*, 36*b* as is generally known for hip rafters.

Figure 4A:
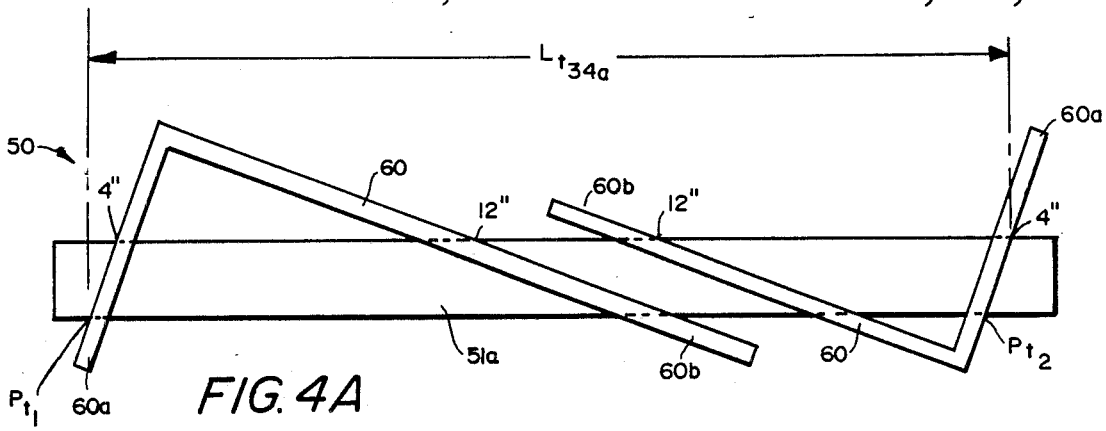
FIG. 4A is a side view of a plank of wood with plumb lines drawn thereon, used in fabricating expansion rafters for the roof of FIG. 1.

Referring first to FIG. 4A, a plank 50 here of wood 4" by 8"nominally dimensional comprised of douglas fir has marked-off on face portion 51*a* thereof, a pair of lines $P_{t1}$, $P_{t2}$ representative plumb lines which determine the cut of such member, here 34*a*, to correspond to the pitch of such member 34*a*. Lines are drawn at each end of the plank 50 representative of the theoretical length of the rafters 34*a*. The determined plumb lines are then drawn across the face 51*a*, of plank 50 at the end portion of the plank corresponding to the theoretical length of the rafter, as shown. Thus, on the face 51*a*, at end portion 50*a* of plank 50 is provided a first plumb line $P_{tl}$ representative of the first plumb cut. End portion 50*a* of the rafter 32*a* shown in FIG. 1 rests against or on and is fastened to the lower hip rafter 42*a* (FIG. 1). Similarly, end portion 50*b* is provided with a second plumb line $P_{tb}$ representative of a second plumb cut, and thus end portion 50*b* is the portion of the expansion rafter, here 34*a* (FIG. 1) which rests against the hip rafter 24*a* of the higher elevation roof 40. Thus, by using a framing square 60 as is known in the art, lines $P_{t1}$, $P_{t2}$ representative of plumb cuts are drawn along the face 51*a* of plank 50 along a tongue 60*a* portion or shorter portion of the framing square which is positioned to denote the unit rise of the rafter 34*a* while a body portion 60*b* or longer portion of the framing square is positioned to denote the unit run of the rafter 34*a*.

For example, as shown in FIG. 3, expansion rafter 34*a* is denoted as the hypothenuse AC of a right triangle ABC, where side 34*a'* (AB) is the length of a rafter 134*a* previously determined to be equal to the sum of the lengths 14*b'''*, 14*c'''*and CB is the elevational difference in the roofs 20, 40 denoted by verticle member 17*a*, 17*b*. The slope of such member 34*a* is determined as rise/run. Thus, here 14*b'' and 14c'''* are each 3 feet or pairs of adjacent jack rafters 23*a*, 23*b* and 43*a*, 43*b* are spaced apart by three feet. The slope is thus 2 ft./6 ft., or put another way there is 24" of rise per six feet of run or 4" rise per foot of run for expansion rafter 34*a*. Similarly, expansion rafter 36*a* has a rise of 2 feet in a run of 12 feet (combined lengths of 14*b''* and 14*c''*), thus, the slope is 2 ft./12 ft. or 24" of rise per 12 feet of run or 2" rise per foot run. Center ridge member 32 similarly has 24" of rise per 18 feet of run or 1.3" rise per foot of run. Thus, here the body portion 60*b* at 12" mark of the framing square 60 is aligned with the plank 50 representative of the unit run of expansion rafter 34*a* and the tongue portion 60*a* at the 4" mark of the framing square is aligned with the plank 50 representative of the unit rise of the roof. The plumb line $P_{t1}$ is drawn at end portion 50*a* by drawing a line from a point on the plank representative of the theoretical length of the rafter as described above, along the tongue portion of the framing square, as shown.

In a similar manner, the plumb line $P_{t2}$ is drawn at end portion 50*b* by moving the framing square 60 to end portion 50*b* such that the tongue portion 60*a* is aligned with the end portion 50*b*, and by drawing a line along the tongue portion of the framing square, as shown in FIG. 4A.

Figure 4B:
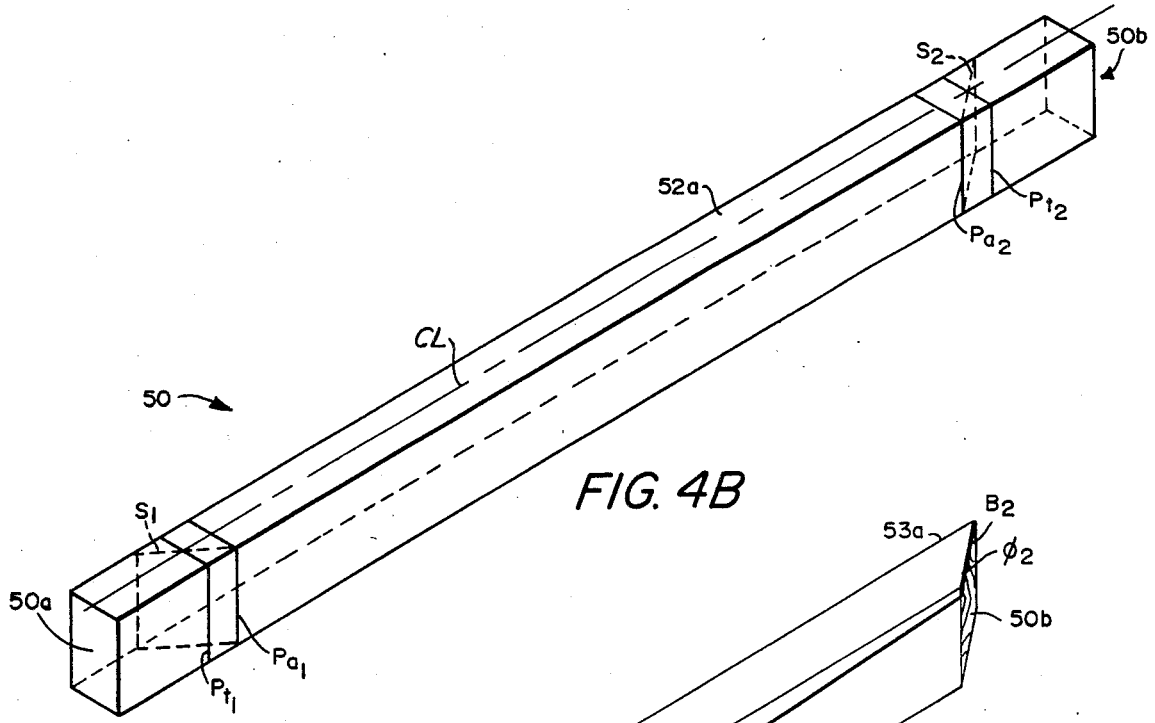
FIGS. 4B–4C are a series of isometric views showing additional steps in construction of the rafters used in a portion of the framing for the roof shown in FIG. 1.

Referring now to FIG. 4B, having drawn lines $P_{t1}$, $P_{t2}$ representative of the theoretical plumb cuts, plumb lines $P_{a1}$, $P_{a2}$ representative of actual plumb cuts through the actual length of the expansion rafter 34*a* (FIG. 1), (i.e. the theoretical length minus the correction for the thickness of hip rafters 24*a*, 24*b* for example, as previously described) are provided. Lines $S_1$, $S_2$ are drawn on an edge portion 52*a* of plank 50, here representing side cuts of the expansion rafter 34*a* or that angle at which the expansion rafter 34*a* joins the hip rafters 24*a*, 44*a*, for example, as shown in FIG. 1. In general, as for hip and valley rafters as is known in the art, the side angle cut is substantially equal to 45° for each one of the expansion rafters. However, as is also known in the art, when joining roofs at different elevations, hip rafter side cuts must be corrected in accordance with the difference in elevation or pitch of the member. Thus, the side cuts are substantially 45°. Here the side cuts are at 44°, 43.5° and 42° for ridge board 32 and expansion rafters 36*a* and 34*a*, respectively.

The location for side cut lines are determined as follows: As shown in FIG. 4B, a centerline $C_L$ is shown drawn on edge 52*a* of plank 50. Plumb lines $P_{t1}$ and $P_{t2}$ on face portions 51*a* of plank 50 are projected across the edge surface 52*a* to intersect the centerline at a right angle. Actual plumb lines $P_{a1}$, $P_{a2}$ are drawn parallel to the theoretical plumb lines $P_{t1}$, $P_{t2}$, through points on the plank 50 determined by the actual rafter length ($l_t - l_{sa} = l_a$ side cut lines $S_1$, $S_2$ are then drawn from the actual plumb lines $P_{a1}$, $P_{a2}$ at the predetermined angle, here of 42° through the intersection of the extension of the theoretical plumb lines $P_{t1}$, $P_{t2}$ and centerline $C_L$ at each end portion 50*a*, 50*b*. A cut is then made with a suitable means, such as a saw through the plank 50 along the side cut lines $S_1$, $S_2$ and along the plumb lines $P_{a1}$, $P_{a2}$ to provide end portions 50*a'*, 50*b'*, as shown in FIG. 4C.

Figure 4C:
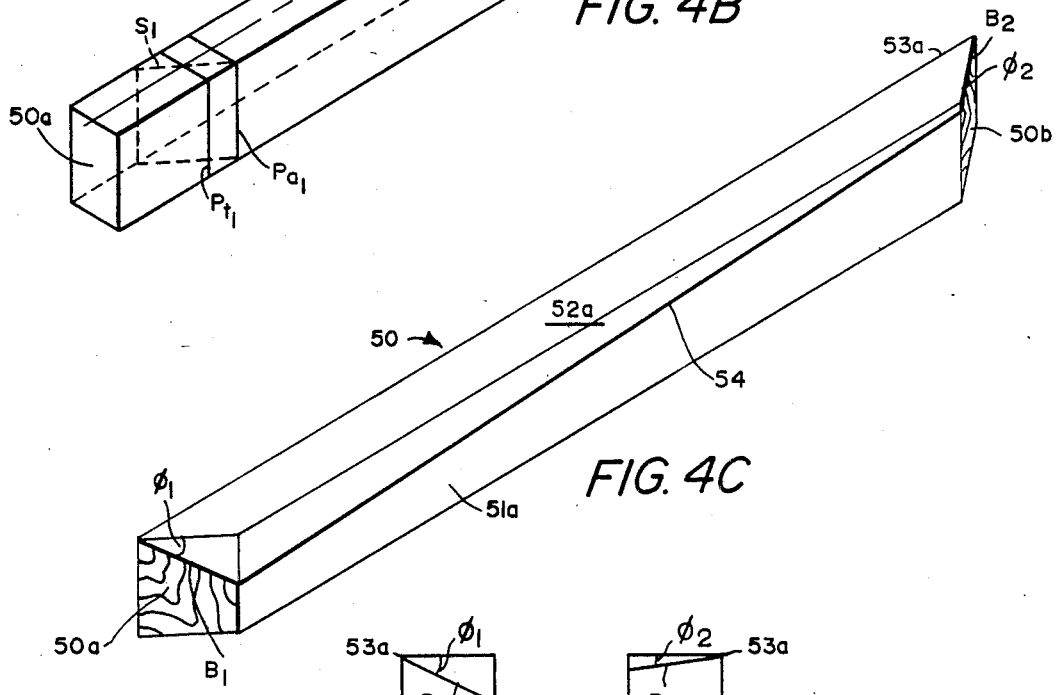

Referring now to FIGS. 4C-4F, a tapered, beveled surface is provided to the plank 50 of FIG. 4C to provide the expansion rafter 34*a* having a tapered, beveled surface 35*a* (FIG. 4F) used in accordance with the roof 30 shown in FIG. 1.

Figure 4D:
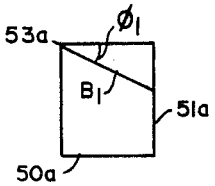
FIGS. 4D–4E are end views of the rafters showing bevel angles used to provide a tapered, beveled surface.
Figure 4E:
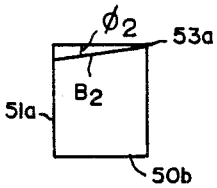

As shown in FIG. 4C, and in more detail in FIGS. 4D, 4E, selected bevel angles $\phi_1$ (FIG. 3D) and $\phi_2$ (FIG. 3E) are marked-off on each end portion 50*a*, 50*b* of the plank 50. These selected bevel angles $\phi_1$, $\phi_2$ provided on end portions 50*a*, 50*b* are determined as follows: The bevel angle $\phi_1$ at end portions 50*a* of plank 50 is determined by the angular sum of the slope of hip rafter 44*a* and the slope of the expansion rafter 34*a*. That is, the slope in degrees of hip rafter 44*a* is the ratio of unit run to unit rise of such hip rafter 44*a*, or $\theta_{44a} = \tan^{-1}(u_{h44a}/u_{r44a})$. The slope in degrees of expansion rafter 34*a* is determined by the tangent of the ratio of unit rise to unit run or the difference in elevation between each of such roofs 20, 40 in relation to the run or length of such rafter 34*a*, as shown in FIG. 2. Thus, the bevel angle $\phi_1$ for end portion 50*a* of plank 50 is given as:

$$\phi_1 = \theta_{44a} + \theta_{34a} \text{ or}$$
$$\phi_1 = \tan^{-1}(u_{h44a}/u_{r44a}) + \tan^{-1}(u_{h34a}/u_{r34a}).$$

Similarly, the slope in degrees of hip rafter 24*a* is determined as the $\theta_{24a} = (\tan^{-1}(u_{h24a}/u_{r24a})$. The bevel angle $\phi_2$ at the end portion 50*b* of plank 50 is determined by the difference of the angular slope of hip rafter 24*a* and the angular slope of expansion rafter 34*a*. Thus, the bevel angle $\phi_2$, for end portion 50*b* is given as:

$$\phi_2 = \phi_{24a} - \phi_{34a} \text{ or}$$
$$\phi_2 = \tan^{-1}(u_{h24a}/u_{r24a}) - \tan^{-1}(u_{h34a}/u_{r34a}).$$

As an example, bevel angles $\phi_1$ and $\phi_2$ are determined as follows: recalling that roofs 20 and 40 each have a pitch of 5"/12" or slope of 22.5° for hip rafters 24*a*, 44*a* and expansion rafter 34*a* has a pitch of 4"/12" as determined above, or a slope of 18.5°, $\phi_1$ and $\phi_2$ are given as $\phi_1 = 22.5° + 18.5° = 41°$, and $\phi_2 = 22.5° - 18.5° = 4°$. The bevel angles $\phi_1$, $\phi_2$ are transferred to the plank 50 with respect to an unbeveled edge 53*a* and lines $B_1$, $B_2$ are drawn along ends 50*a'*, 50*b'* to the surface portion 51*a* of the plank 50 as shown in FIGS. 4D, 4E. A tapering line 54 is then drawn along surface portion 51*a* interconnecting such markings, indicating the taper of the expansion rafter.

The tapered, beveled surface 35*a* and a curvatured centerline 35*b* are then provided to plank 50 by planing the surface of the plank along the above-mentioned tapering line 54, from the unbeveled edge 53*a*, until the plane runs flat along unbeveled edge 53*a* and the tapering line 54 providing the expansion rafter 34*a* having the tapered, beveled surface 35*a* and curved centerline 35*b*, as shown in FIG. 4F. Each one of such remaining rafter members 34*b*, 36*a*, 36*b* and ridge board 32 are fabricated in a similar manner. Each pair of such members, namely, 34*a*, 34*b* and 36*a*, 36*b* have different plumb angles determined in accordance with the respective pair of such members. Further, each member of such pairs are fabricated in complement as generally done for hip rafters, as is known in the art.

Center member 32 is fabricated in a similar fashion as rafter members 34*a*, 34*b*, 36*a*, 36*b*, however, a pair of bevel taper surfaces are provided on center member 32. A pair of tapering lines are drawn on opposing facial surfaces (not shown) of center member 32 and such member is planed along each one of the tapering lines, with respect to a centerline (not shown) drawn down the center of the plank, providing the pair of beveled surfaces 32', 32" shown in FIG. 2A.

Figure 5:
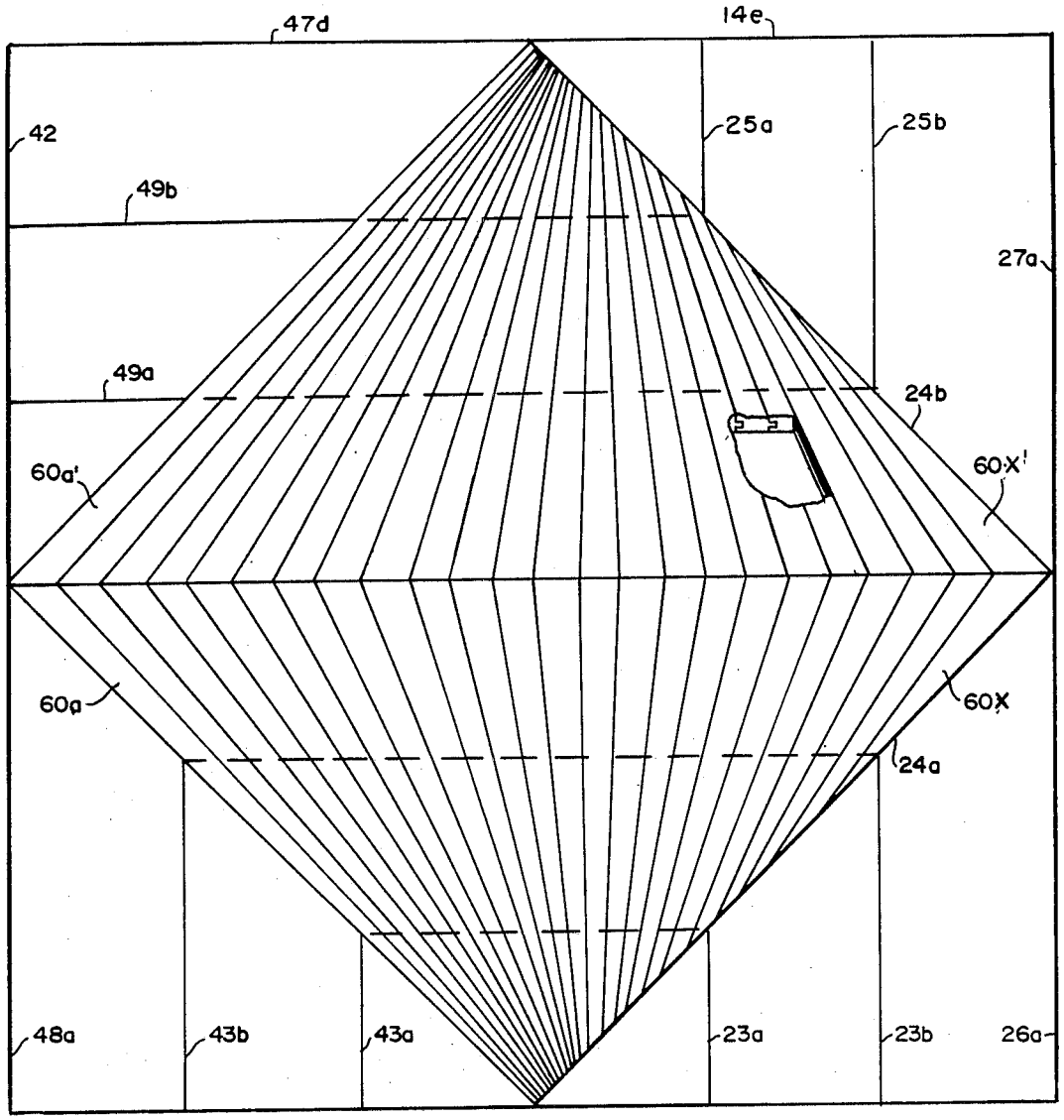
FIG. 5 is a plan view of a portion of the roof shown in FIG. 1 with sheathing disposed across the expansion rafters.
Figure 6:
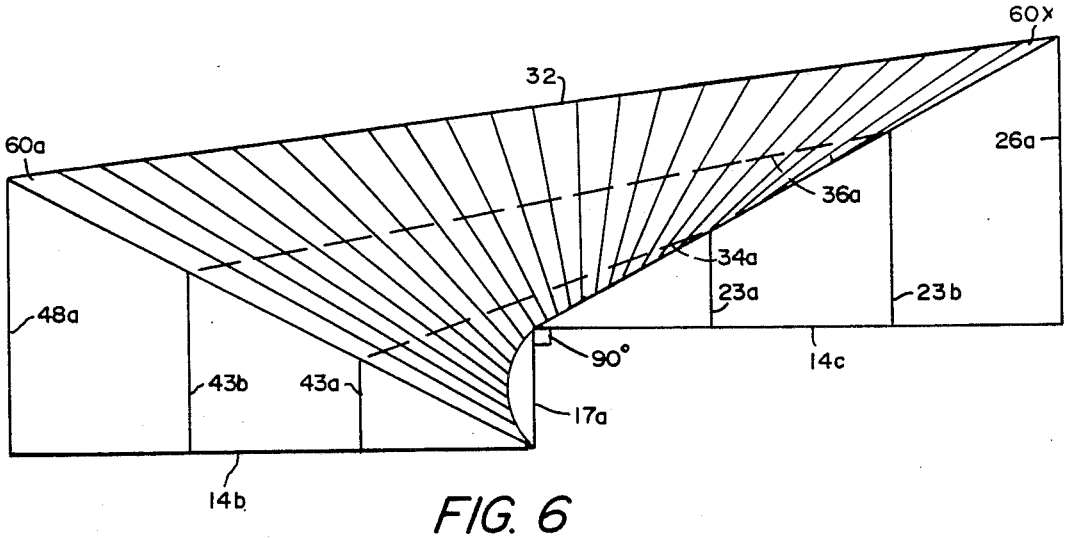
FIG. 6 is an elevational view of a portion of the roof shown in FIG. 1 and FIG. 5.

Referring now to FIGS. 5 and 6, a preferred covering for the expansion roof 30 is shown to include a plurality of selectively tapered sheathing members 60*a*–60*x* and 60*a'*–60*x'*, disposed across the expansion rafters 34*a*, 34*b*, 36*a*, 36*b*, as shown. It is also to be noted that the sheathing is here tongue and grooved after cutting thereof, to provide an intimate fit between each of such members. However, other types of sheathing may be used including "ship lap" style and squared edged sheathing, as is known in the art. The tapered tongue and groove members 60*a*–60*x* and 60*a'*–60*x'* are fabricated as follows: each one of such members 60*a*–60*x*, 60*a'*–60*x'* have a first end portion having a width $W_{60}$ given as $W_{60} = l_{a32}/n$ where $l_{a32}$ is the actual length of the expansion ridgeboard 32 and n is the member of sheathing members, here shown as 24. Each one of such members 60*a*–60*x* and 60*a'*–60*x'* have a bottom width given as $90° - 22\frac{1}{2}°/24 = 67\frac{1}{2}/24 = 2\frac{3}{4}°$. Since the roof 30 is bounded by hip rafters such as 44*b*, 24*a* which have equal lengths and intersect at a right angle, 1° of pitch is equal to 1" of bottom width. Thus, here stock planks 12" wide are ripped to provide pairs of such sheathing elements 60 and 60', which may be provided on opposite surfaces of the roof 30. The cut planks may at this point be tongue and groove, and are then fitted into place by scribing and cutting the ends to fit in place, as is known in the art.

It is here to be noted that, as shown in FIG. 6, tapered sheathing members are laid across the expansion rafters 34*a*, 34*b*, 36*a*, 36*b* and ridge board 32, the pitch of sheathing members will gradually increase upward, following the tapered, curvatured surface of the expansion rafters 34*a*, 34*b*, 36*a*, 36*b* providing a fan-like appearance to the roof 30 when covered with such sheathing.

It is to be noted that the expansion roof may be fabricated by using expansion rafters not having a tapered, beveled surface. However, it shoud also be noted that when sheathing members are laid across such expansion rafters, the sheathing will not adequately follow the pitch of the roof leaving large voids between the sheathing members and portions of the expansion rafter. Thus, the preferred embodiment of the invention uses expansion rafters 34*a*, 34*b*, 36*a*, 36*b* having a tapered, beveled surface.

It is also to be noted that the expansion roof 30 may be fabricated with expansion rafters, provided with a beveled edge instead of the tapered, beveled edge providing the curvatured centerline described above. However, as described above, when roof sheathing is laid across these expansion rafters, the sheathing again will not adequately follow the pitch of the rafters and thus voids will exist between the sheathing and expansion rafter members.

However, for the situation where the adjoining roof 20 is at the same elevation and same pitch, then the slope of the horizontal or expansion rafter members will be equal to zero and thus the bevel angles $\phi_1$, $\phi_2$ provided at end portions of the expansion rafters will be equal and thus a straight bevel may be cut along the selected surface of the expansion rafter, and such rafter will have a beveled edge without the curvatured centerline.

Further, it should also be noted that the expansion roof need not adjoin other roofs. That is, in certain applications, a suitable covering may be provided solely with a properly supported expansion roof.

Having described preferred embodiments of the invention, it will now be apparent to one of skill in the art that other embodiments incorporating its concept may be used. It is felt, therefore, that this invention should not be restricted to the disclosed embodiments, but rather should be limited only by the spirit and scope of the appended claims.

What is claimed is:

1. A roof structure comprising: means for providing a frame to connect a pair of adjacent roofs, said means comprising:

a first pair of hip rafters of a first one of said roofs, each hip rafter of said first pair of hip rafters having a first end and a second end, said first ends being connected together at first common point, with said first common point being disposed in elevation over the second ends of said first pair of hip rafters;

a second pair of hip rafters of a second one of said roofs, each hip rafter of said second pair of hip rafters having a first end and a second end, said first end being connected together at a second, different common point, with said second common point being disposed in elevation over the second ends of said second pair of hip rafters;

a ridge board member connected between the common points of each pair of hip rafters; and wherein the second end of each hip rafter of said first pair of hip rafters is disposed adjacent to the second end of a corresponding hip rafter of said second pair of hip rafters with said ridge board member being disposed in elevation over the second ends of said hip rafters, and with each hip rafter of the first pair diverging away from the corresponding hip rafter oif the second pair beginning at the adjacently disposed second ends of said pairs of hip rafters.

2. The framing structure as recited in claim 1 wherein said second ends of the first pair of hip rafters are disposed over corresponding ones of the second ends of the second pair of hip rafters.

3. The framing structure as recited in claim 2 further comprising:

a plurality of spaced rafter members disposed between corresponding ones of each pair of hip rafters.

4. The framing structure as recited in claim 1 wherein the second end portions of corresponding ones of said pairs of hip rafters are connected together.

5. The framing structure as recited in claim 1 further comprising:

a pair of vertically disposed members; and wherein the second ends of said first pair of hip rafters are connected to first ends of said pair of vertical members and said second ends of said second pair of hip rafters are connected to second ends of said pair of vertical members.

6. A framing structure comprising:

means for spanning a pair of adjacent roof frames with a first one of said frames providing a roof having a first elevation, and a second on of said frames providing a roof having a second, higher elevation further comprising:

a first pair of hip rafters associated with the first roof connected at a first common point;

a second pair of hip rafters associated with the second roof connected at a second common point;

a ridge member connected between the first and second common points of said first and second pair of hip rafters; and a pair of verticle members, each having a length related to the elevation difference between said roof with second end portions of the first pair of hip rafters being connected to corresponding first end portions of said pair of verticle members and second end portions of the second pair of hip rafters being connected to corresponding second end portions of the pair of verticle members.

7. The framing structure as recited in claim 6 wherein the ridge member includes a pair of beveled surfaces provided substantially along a pair of side portions of said ridge member.

8. The framing structure as recited in claim 7 wherein the bevel surfaces of said ridge member are tapered and with the degree of said tapered surface being related to a first pair of angular displacements on a first end portion of said ridge member, and a second pair of angular displacements on a second opposite end portion of said ridge member with said angular displacements being related to the elevation and pitch of each of said roofs.

9. The framing structure as recited in claim 8 wherein the first pair of angular displacements is related to the difference between a slope of one of said roofs, and the slope of said ridge member, and wherein the second pair of angular displacements is determined by the sum of a slope of a second one of said roofs and the slope of the ridge member.

10. The framing structure as recited in claim 6 further comprising at least a pair of rafter members extending between corresponding ones of each pair of hip rafters.

11. The framing structure as recited in claim 10 wherein each rafter member includes a beveled edge surface.

12. The framing structure as recited in claim 11 wherein each beveled edge surface includes a first angular displacement at a first end of said rafter member and a second, different angular displacement at a second end of said rafter member.

13. The framing structure as recited in claim 12 wherein the first angular displacement is related to the difference between a slope of one of said roofs and a slope of said rafter member and the second angular displacement is related to the sum of the slope of a second one of said roofs and the slope of the rafter member.

14. A roof for a building structure comprising:

a first pair of hip rafters, each hip rafter having a first end connected at a first common junction and each hip rafter having a second end connected to one of a corresponding pair of opposing sidewalls of the building structure, with said first common junction being disposed in elevation over said pair of opposing sidewalls;

a second pair of hip rafters, each hip rafter having a first end connected at a second, different common junction and each rafter having a second end disposed adjacent to the second end of a corresponding one of said first pair of hip rafters, said second ends being connected to said pair or sidewalls of the building structure, with said second common junction being disposed in elevation over said pair of opposing sidewalls, and with each hip rafter of the second pair divering away from the corresponding hip rafter of the first pair beginning at the adjacently disposed second ends of said pairs of hip rafters; and a ridge board member disposd in elevation over the second ends of said first and second pairs of hip rafters, with said ridge board member being connected between the first and second common junctions.

15. The roof of claim 14 further comprising a plurality of horizontally spaced members connected between corresponding ones of said pair of hip rafters.

16. The roof of claim 15 further comprising means for providing a covering disposed over said hip rafters, ridge member and horizontally spaced members.

* * * * *